United States Patent [19]

Dash

[11] Patent Number: 4,666,568

[45] Date of Patent: May 19, 1987

[54] ELECTROLYTIC CODEPOSITION OF METALS AND NONMETALLIC PARTICLES

[75] Inventor: John Dash, Portland, Oreg.

[73] Assignee: State of Oregon acting by and through the State Board of Higher Education on behalf of Portland State University, Portland, Oreg.

[21] Appl. No.: 917,428

[22] Filed: Oct. 10, 1986

[51] Int. Cl.[4] ..... C25D 15/00

[52] U.S. Cl. ..... 204/16

[58] Field of Search ..... 204/16, DIG. 5

[56] References Cited

U.S. PATENT DOCUMENTS 3,061,525 10/1962 Grazen ..... 204/16

*Primary Examiner*—T. M. Tufariello

*Attorney, Agent, or Firm*—Kolisch, Hartwell & Dickinson

[57] ABSTRACT

A method of electrolytically codepositing a composite of a metal and nonmetallic insoluble particles on the cathode of an electroplating cell a magnetic field used to produce movement and suspension of the particles in an electrolyte containing the metal in ionic form.

8 Claims, 5 Drawing Figures

1 mm

1 μm

10 μm

1 μm

ELECTROLYTIC CODEPOSITION OF METALS AND NONMETALLIC PARTICLES

BACKGROUND AND SUMMARY OF THE INVENTION

This invention relates to electrolytic codeposition of metals and nonmetallic water-insoluble particles on an electrode in a electrolytic cell.

There are many industrial applications where it is advantageous to utilize a mixture of a metal and other materials to produce improved properties not possessed by the metal in its pure form. By way of example, copper is well known as being an excellent electrical conductor, but in its essentially pure form, copper is relatively soft, and thus tends to have inferior tensile strength and wear resistance. Alumina particles, on the other hand, are extremely hard, and for this reason have found extensive use as an abrasive-type of material. A composite of copper and alumina particles in certain applications such as switch contacts, etc. have the conductive properties desired, coupled with a hardness and related wear resistance which are considerably enhanced over that possessed by pure copper.

A general object of this invention is to provide an improved method for depositing electrolytically a composite of a metal and nonmetallic particles on an electrode surface.

More specifically, the invention concerns such a method which relies upon establishing a magnetic field which extends through an electrolyte solution containing ions of the metal to be deposited and further containing the particles in a suspendible form. With passage of an electric current between spaced electrodes immersed in such a solution, enhanced codeposition of the metal and the particles occurs on an electrode surface.

Following the invention, and through interaction of the magnetic field with the current passing between the electrodes, motion is imparted to the particles which before interaction resided in a quiescent state and as a bed at the bottom of the cell. This motion is in a spiraling course, and after a period of time, is effective to produce dispersion of the particles throughout the electrolyte solution. This movement of the particles is further accompanied by movement of the electrolyte solution effective to reduce the thickness of the diffusion layer which normally exists at the electrode surface where deposition occurs. The consequence of these actions is the codeposition of metal and particles on the electrode surface with the deposit produced being superior to those realized utilizing prior art techniques. In certain instances, codeposition is produceable with particles that prior researchers have found nearly impossible to codeposit utilizing electrolytic techniques. Other advantages have been observed, such as the possibility of using higher current densities during the electrolytic process.

These and other objects and advantages of the invention will become further apparent from a reading of the following description, which is to be taken in conjunction with the accompanying drawings, wherein.

DETAILED DESCRIPTION OF THE PREFERRED EMBODIMENT

Figure 1:
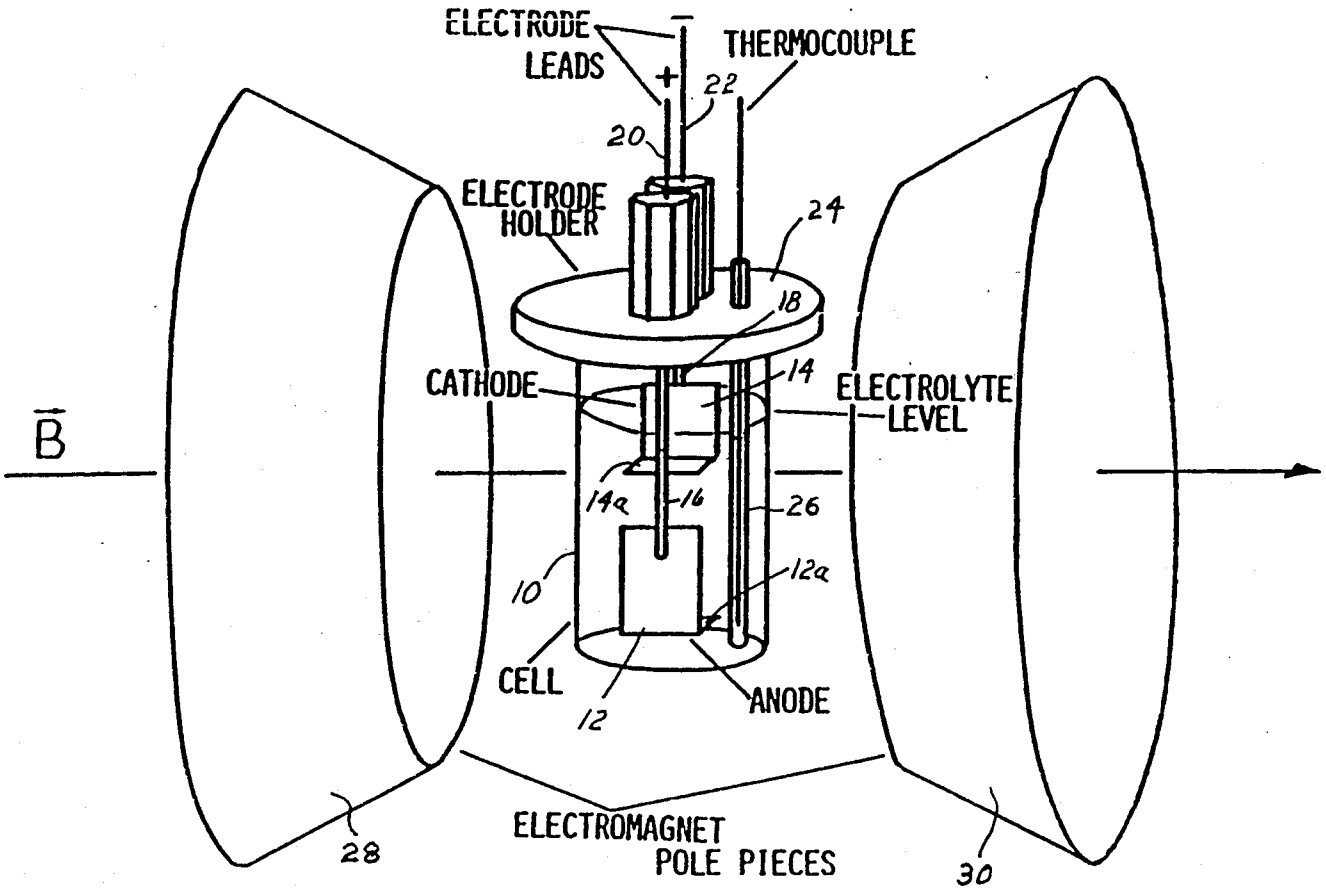
FIG. 1 is a perspective view illustrating apparatus that may be employed in carrying out the invention.

Referring initially to FIG. 1, wherein apparatus is illustrated which is usable in practicing the invention, the apparatus includes a vessel or beaker 10 for containing the electrolyte solution used and forming the outside of the electrolytic cell. Positioned within this vessel are a pair of spaced electrodes, namely, anode 12 and cathode 14. Each electrode is formed of a copper sheet and includes a horizontal expanse of square configuration, indicated for the anode at **12*a* and for the cathode at 14*a*. These expanses connect with vertically-extending expanses and via conductors 16 and 18 to electrode leads 20, 22 through which an electric current is supplied to the electrodes in the cell. Providing a mounting for the electrodes is electrode holder 24. A thermocouple shown at 26** is provided to permit monitoring of the temperature of the electrolyte solution The vessel described may be made of glass and all other components made of a nonmagnetic material.

Positioned on either side of vessel 10 and spaced therefrom are a pair of electromagnet pole pieces shown at 28 and 30. During operation of the apparatus, such are magnetized to produce opposite faces of opposite magnetic polarity whereby a magnetic field is created which passes through the cell.

Describing dimensions of a particular apparatus used in performing the examples herein set forth, pole pieces were provided with opposed faces spaced approximately 6 centimeters apart. The vessel had an inner diameter of approximately 2 centimeters and a height of approximately 4 centimeters. Each pole piece face was spaced approximately 2 centimeters from a side of the vessel. The spacing between the horizontal expanses of the electrodes was approximately 2 centimeters.

The apparatus described was utilized in the codepositing of a metal capable of electrodeposition, namely, copper, and water-insoluble, nonmetallic particles, namely, alumina particles, through electrolysis on the surface of the cathode 14.

As is recognized in the art, powdered or particulate alumina ($Al_2O_3$) is commercially available in two distinct crystalline types, namely, alpha alumina (which typically has a particle size of 0.3 microns) and gamma alumina (which typically has a particle size of 0.05 microns). The literature indicates that the larger alpha alumina is codepositable with copper in an electrolytic process, but indicates no success generally in the codeposition of the smaller gamma alumina as available commercially. Utilizing the invention, both alpha and gamma alumina are codepositable, and the deposits produced are hard and of good quality.

The following example illustrates the preparation of a codeposit of copper and gauma alumina following the invention.

EXAMPLE 1

The anode and cathode in the cell were coated over their entireties with an insulative lacquer coating save for the top and bottom faces of expanse **12*a* of the anode and the top face of expanse 14*a*** of the cathode. In this way, gravitational force supplements other forces in producing deposition of material.

The vessel in the cell was filled to a height of approximately 3 centimeters with electrolyte solution and with the inclusion in the solution of gamma alumina, with the dry volume of the alumina being approximately 8.5 percent of the volume of the electrolyte solution. The electrolyte solution was an acidic aqueous solution, containing 0.5 M sulfuric acid and 0.5 M Cu $SO_4.5H_2O$.

In carrying out the codeposition, the electrolyte was maintained at a temperature of 20° C. The intensity of the magnetic field between the pole pieces was 7.4 kilogauss. A current density at the cathode was maintained at 0.05 A/cm$^2$. Electrolysis was continued for a period of 48 minutes.

Prior to magnetization of the pole pieces and passage of the current between the electrodes, the alumina was observed to form a quiescent bed at the base of vessel 10. With start of the electrodeposition, i.e., magnetization of the pole pieces and passage of the current between the electrodes, upwardly spiraling movement of the particulate was observed extending toward the cathode. After the passage of approximately 30 seconds, the anode became barely visible. After several minutes, the turbidity of the solution was such as to obscure both the anode and the cathode.

Figure 2:
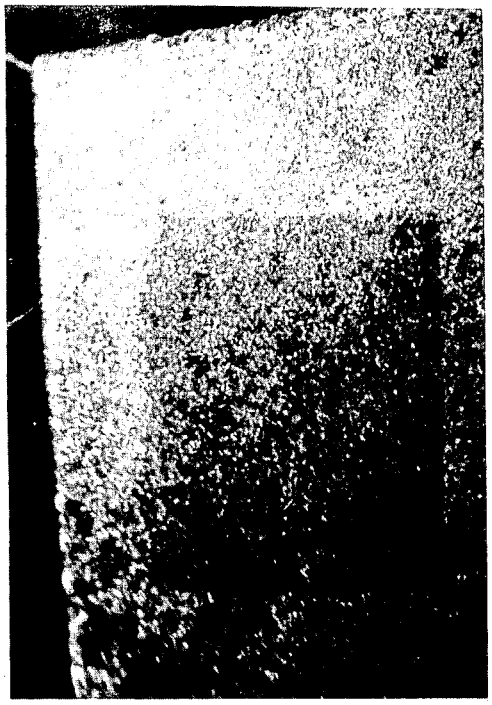
FIG. 2 is a photomicrograph of portions of the surface of an electrode codeposited with copper and alumina pursuant to the invention.

At the conclusion of the electrodeposition, the exposed surface of expanse 14*a* in the cathode was coated with a hard, uniformly applied coating. The coating that resulted is pictured in FIG. 2, which is at approximately 17 times magnification.

The coating of the cathode surface was analyzed with an energy dispersive spectrometer attached to a scanning electron microscope. Such indicated that the coating consisted of approximately 50 percent by volume alumina and 50 percent by volume copper.

The alumina utilized was the commercially available type, analyzed to have as an impurity approximately 2 parts per million chloride ion.

The application of the magnetic field across the electrolyte solution and its interaction with the current flow between the electrodes in the cell and the magnetic field resulting from such current flow produced, as indicated above, particle movement resulting in dispersion of the particles throughout the electrolyte solution. A further result of the application of the magnetic field was the reduction of the thickness of the diffusion layer which ordinarily exists in covering relation over an electrode surface during an electroplating operation. Further explaining, the concentration of depositing ions at the interface of the electrolyte and the electrode receiving the ions is zero, and this concentration increases in a zone extending away from the electrode surface until a region is reached where the concentration of ions equals the average concentration of the bulk solution. The diffusion layer refers to this zone where ion concentration is less than the average concentration of the bulk solution, and normally in mechanical systems approximates 0.1 millimeter in thickness. Employing the invention, i.e., the magnetic system described herein, the thickness of the diffusion layer reduces to approximately 0.001 millimeter in thickness. It is this reduction in the thickness of the diffusion layer which is felt to contribute materially to the efficacy of the electrodeposition method contemplated.

As stated earlier, prior investigators have had little success in codepositing gamma alumina in an electrolytic process, which is felt to be because of chloride ion impurity borne by the surfaces of the gamma particles. Because of the small size of the particles and the presence of the negative charge that results, the particles tend to be deflected from the cathode surface. Following the magnetic system of the invention, these chloride ion impurities apparently are agitated or brushed off the surfaces of the particles rendering the particles amenable to collection on the cathode. This has been confirmed by experiments that have been performed with the intentional addition of chloride ions, and that evidence successful codeposition of the gamma alumina having up to 700 parts per million chloride ion.

Other advantages that have been noted to flow from the magnetic system herein described include the ability to use relatively high current densities in the codeposition process. The presence of the diffusion layer above-indicated with conventional processes tends to limit current densities that are usable if good coatings are to result. An excessive current density results in copper depositing as copper powder rather than as material collected on the cathode surface.

EXAMPLE 2

In another preparation, the cell illustrated in FIG. 1 was employed, with the exception that the bottom surface of cathode expanse 14*a* was left exposed and free of insulative coating rather than the top surface. The electrolysis was performed as in Example 1 with gamma alumina, but at a temperature of 22° C., utilizing a current density of 0.08 A/cm$^2$.

Figure 3:
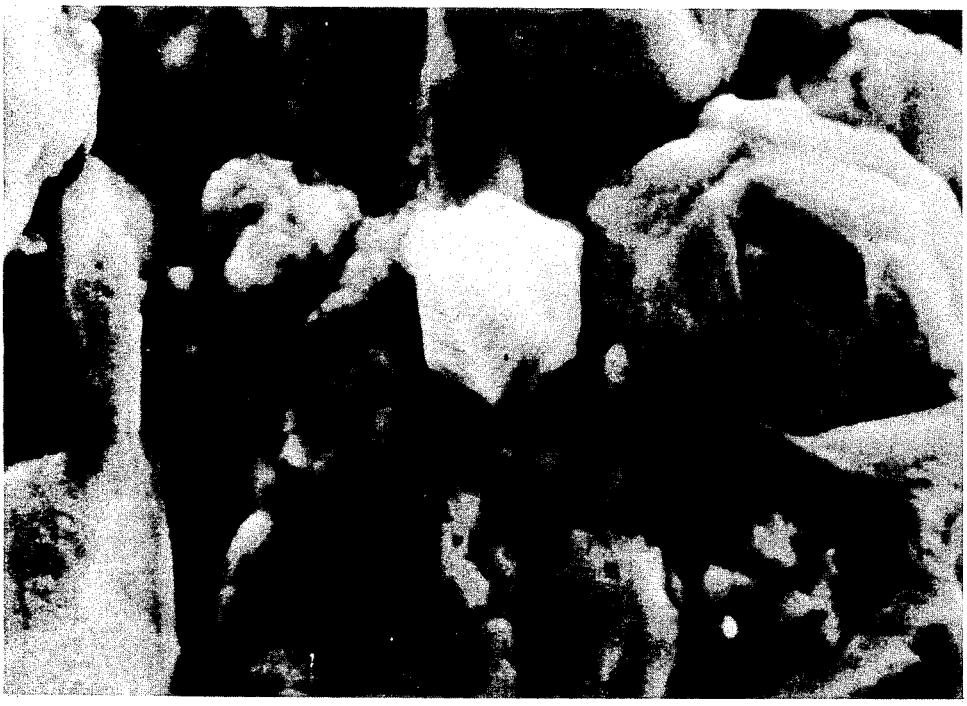
FIGS. 3, 4 and 5 are additional photomicrographs further illustrating codeposited surfaces prepared according to the invention.

A coating was prepared which through analysis was found to contain 2 percent by volume alumina. FIG. 3 is a photomicrograph of the resulting coating at 4,000 times magnification. Appearing approximately centrally in the photomicrograph is a white crystalline object having the appearance of being an alloy of alumina and copper. Analysis of this crystalline object with an energy dispersive spectrometer showed that the object contained 25 percent by volume alumina. The average volume percent content of the coating was found to be 2 percent. The particle size of the crystalline-appearing object was measured at 10 microns.

EXAMPLE 3

In another preparation, electrodeposition of gamma alumina was performed using the apparatus shown in FIG. 1 modified to the extent that the cathode surface receiving the deposit was arranged in a vertical plane. The temperature of the electrolyte solution was 22° C., and the current density employed was 0.5 A/cm$^2$, and the electrodeposition was performed over a period of 16.7 minutes.

Figure 4:
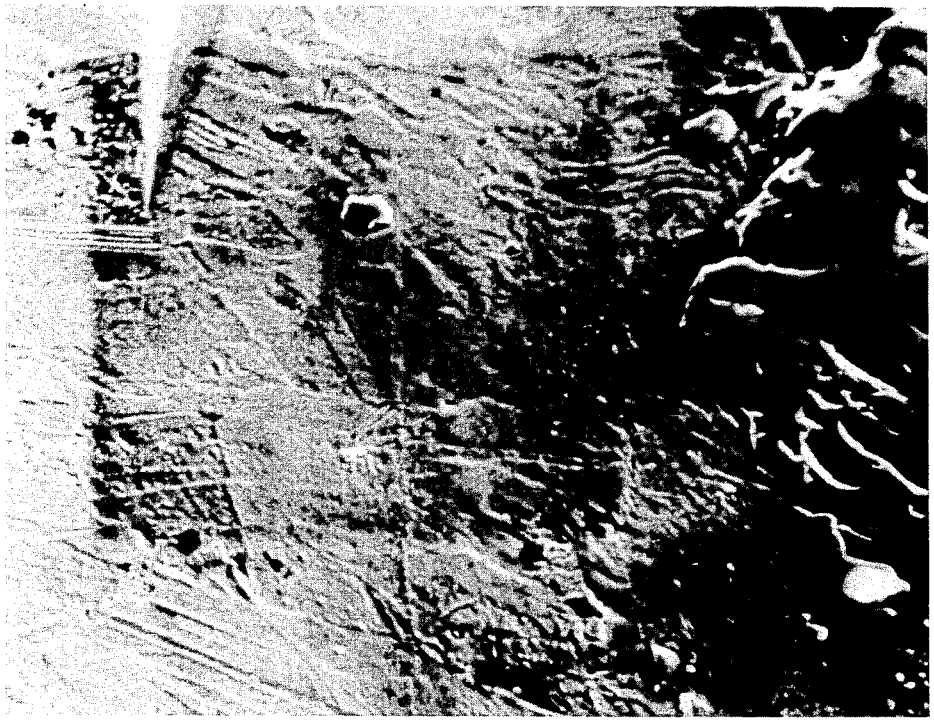

FIG. 4 is a photomicrograph taken of the coating that resulted on the cathode surface at 1250 times magnification. The globule, for instance, which appears at the upper center portion of the figure was analyzed with an energy dispersive spectrometer and found to contain about 35 volume percent alumina. The average alumina content of the coating was found to be 2 volume percent.

EXAMPLE 4

In another preparation, alpha alumina was utilized (0.3 micron particle size). The apparatus used was equipped with the cathode surface receiving deposition material facing downwardly as in Example 2. The current density employed was 0.6 A/cm$^2$, and the temperature of the electrolyte solution was 64° C. Electrodeposition took place over a period of 4 minutes.

Figure 5:
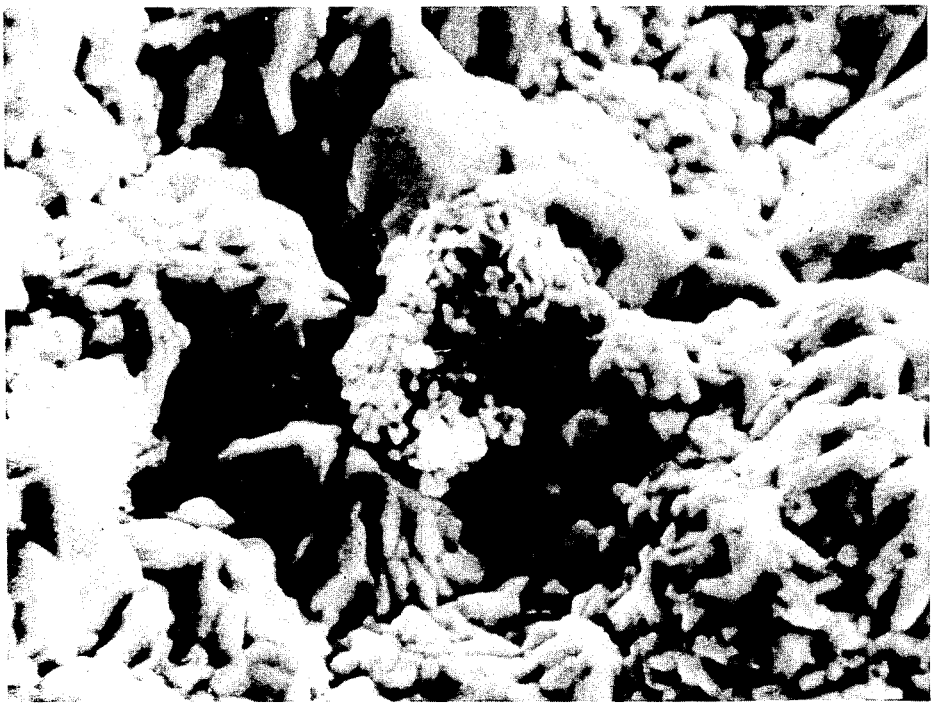

FIG. 5 is a photomicrograph at 4000 times magnification of the coating that resulted on the cathodic surface. The convoluted aggregate shown centrally of the figure was analyzed with an energy dispersive spectrometer and found to contain approximately 35 percent by volume alumina. The average alumina content of the coating was 2 volume percent.

Coatings were prepared utilizing electrolyte solutions ranging in temperature from about 15° to 90° C. Generally speaking, and as exemplified utilizing a standard electrolyte solution as set forth in Example 1 and containing alpha alumina, with a cell voltage of approximately 0.8 volts and a temperature of 16° C. for the electrolyte, the current density in the cell was in the neighborhood of 0.15 A/cm$^2$. With increasing of the temperature of the electrolyte to 32° C., the same cell voltage produced a current density of between 0.25 and 0.30 A/cm$^2$. With a temperature in the electrolyte of 64° C., the same cell voltage resulted in a current density of approximately 0.50 A/cm$^2$. The results indicate that with higher temperatures, higher current densities are possible. With the higher current densities, compact deposits were still obtained.

Coatings were electrodeposited utilizing an electrolyte solution of the composition set forth in Example 1, and including alpha alumina. The temperature of the electrolyte was 64° C. With an increase in the current densities used in the cell, coatings produced were found to have progressively increased hardness. For instance, a hardness was noted in coatings produced utilizing a current density of 0.55 A/cm$^2$, approximately doubling the hardness (Knoop Hardness Number) of coatings produced utilizing a current density of 0.25 A/cm$^2$.

EXAMPLE 5

In another preparation, the equipment and operating procedures utilized in Example 1 were employed in the preparation of a coating from gamma alumina, modifying the procedure to the extent that the current density employed was increased to 0.2 A/cm$^2$. In this instance, a coating adhering to the cathodic surface was not formed, but instead a particulate composition was produced which was removable from the cathode's surface Analysis with an energy dispersive spectrometer revealed the particle material to contain approximately 50 percent by volume alumina. The particles obtained has an approximate mean size of 5 microns, lending them for use in the production of articles utilizing powder metallurgical techniques.

From the above, it can be seen that electrodeposition utilizing the magnetic procedure outlined is effective to produce coatings and powders as a codeposition product which are a composite of the depositing metal ions in the electrolyte solution and the undissolved inorganic particles which are included in the electrolyte solution and become suspended during the process. The process makes possible the production of superior coatings utilizing relatively high current densities in the cell, and enables use of particulate matter, as exemplified by the gamma alumina, which heretofore has not been employed in preparing codeposition coatings. A modification of the process produces powdered material usable in other applications of product formation.

It is claimed and desired to secure by Letters Patent:

1. A method of electrolytically codepositing metal and nonmetallic insoluble particles which comprises:

providing an electrolyte solution containing the metal as ions and further containing the insoluble particles suspendible in the solution, establishing a magnetic field passing through the solution, passing a current between spaced anode and cathode elements immersed in said solution, and through interaction of the magnetic field and the electric current passage between the anode and cathode elements producing movement of the particles whereby such becomes suspended in the solution and producing movement of the solution to reduce the diffusion layer which forms during electrolysis on the surface of the cathode element with such being effective to produce depositing of particles on the surface of the cathode element together with metal derived from the metal ions.

2. The method of claim 1, wherein the surface of the cathode element where deposition occurs faces upwardly in the electrolyte solution.

3. The method of claim 1, wherein the temperature of the electrolyte is maintained within the range of about 15° to 90° C.

4. A method of electrolytically codepositing copper and alumina comprising:

providing an aqueous acidic electrolyte solution containing copper ions and further containing alumina particles suspendible in the solution, establishing a magnetic field passing through the solution, passing a current between spaced anode and cathode elements immersed in said solution, and through interaction of the magnetic field and the current passage between the anode and cathode elements producing movement of the alumina particles in the solution to thereby disperse them in the solution and producing movement of the electrolyte to reduce the diffusion layer that forms during electrolysis over the cathode element surface with such being effective to produce codeposition of copper and alumina on the surface of the cathode element.

5. The method of claim 4, wherein the alumina particles are gamma alumina particles.

6. The method of claim 5, wherein the electrolyte solution is an aqueous solution of copper sulfate and sulfuric acid.

7. The method of claim 6, wherein the temperature of the electrolyte is maintained within the range of about 15° to 90° C.

8. The method of claim 5, wherein the surface of the cathode element faces upwardly in the electrolyte solution.

* * * * *